US005760695A

United States Patent [19]

Huber

[11] Patent Number: 5,760,695

[45] Date of Patent: Jun. 2, 1998

[54] APPARATUS FOR HYDRAULIC ACTUATION OF A HINGED COVER

[75] Inventor: Gerhard Huber, Frankenhofen-Kaltental, Germany

[73] Assignee: Hoerbiger GmbH, Germany

[21] Appl. No.: 845,143

[22] Filed: Apr. 21, 1997

[30] Foreign Application Priority Data

Apr. 24, 1996 [AT] Austria ..... 747/96

[51] Int. Cl.[6] ..... G08B 21/00

[52] U.S. Cl. ..... 340/614; 340/626; 296/107; 296/117; 91/494; 91/530

[58] Field of Search ..... 340/611, 614, 340/626; 91/494, 530; 296/100, 107, 117

[56] References Cited

U.S. PATENT DOCUMENTS 4,533,908 8/1985 Fujikawa ..... 340/626
5,110,175 5/1992 Fischback ..... 296/117
5,335,926 8/1994 Stolle ..... 296/117
5,682,807 11/1997 Mentink ..... 91/530

*Primary Examiner*—Edward Lefkowitz
*Attorney, Agent, or Firm*—Watson Cole Stevens Davis, P.L.L.C.

[57] ABSTRACT

An apparatus for hydraulic actuation of a hinged cover on a vehicle having a working cylinder such that work spaces within the cylinder are respectively connected, via check valves, to a reversible pressure source. The check valves respectively contain a reciprocal unclosing facility, and the work spaces are connected, via a pilot valve, in parallel to the check valves. Between the one of the work space and one of the check valves, an emergency valve guiding off to the tank is interposed and is shut off during normal operation of the apparatus to allow a safe emergency actuation of the hinged cover.

16 Claims, 3 Drawing Sheets

APPARATUS FOR HYDRAULIC ACTUATION OF A HINGED COVER

BACKGROUND OF THE INVENTION

1. Field of the Invention

The present invention generally relates to an apparatus for hydraulic actuation of a hinged cover in a vehicle, and more particularly, to a hydraulic actuation apparatus having at least one double acting hydraulic working cylinder supported by both the vehicle and hinged cover in a way that the working spaces within the hydraulic working cylinder are connected to a reversible pressure source via check valves.

2. Description of the Related Art

A conventional hydraulic actuation apparatus (e.g. DE 43 34 843 A1) is used for, for example, automatic actuation of vehicle doors, engine hoods, maintenance flaps, hinged covers of the trunk, or folding tops. Particularly, the reciprocally unclosable check valves within the conventional apparatus ensure that if the working pressure fails or is switched off, the hinged cover remains stationary in a given position so as to eliminate any uncontrolled movements and related dangers. During this period, a controlled movement of the hinged cover can be manually accomplished by hand. That is, the position of the hinged cover can be manually shifted by creating an "overpowering" force using hand against the "stationary" force provided by a pilot valve.

One of the drawbacks associated with the conventional hydraulic actuation apparatus is that the described emergency actuation is possible only in connection with a volume-controlled working cylinder. Otherwise, there are problems associated with the removal or supplying of a hydraulic medium to the work space at either side (i.e., piston or rod side) of the cylinder. Moreover, even if one were to guide off the excess volume of the hydraulic medium pushed out of one work space into the tank, problems remain with respect to the subsequent supplying of the hydraulic medium into the other work space. This is due to the fact that lines used in a vehicle, although very thin and flexible, are relatively long as to create a cramped arrangement such that the auctioning work space is at least partially filled with air blowing out. The result is that, after manually actuating and releasing the hinged cover during the power-failure period, it may fall back in an indeterminate manner and cause damage and injuries.

SUMMARY OF THE INVENTION

It is, therefore, an object of the present invention to avoid the above-mentioned problems by providing an apparatus for hydraulic actuation of a hinged cover in a vehicle such that a simple and safe operation of the hinged cover can be accomplished during an emergency actuation.

According to the invention, there is provided an apparatus for hydraulic actuation of a hinged cover on a vehicle. The actuation apparatus has a double-acting hydraulic working cylinder having first and second work spaces on piston and rod sides of the cylinder, respectively, in which the cylinder hinging on both the vehicle and the hinged cover. Additionally, the actuating apparatus has a reversible pressure source, first and second check valves which are reciprocally unclosable, a pilot valve, and an emergency valve interposed between the first work space and the first check valve, wherein the first and second work spaces in the cylinder are connected to the reversible pressure source via the first and second check valves, and connected in parallel with the first and second check valves via the pilot valve, and wherein the emergency valve guides, which can be hydraulically shut-off, guides an excess pressure medium to a tank when an adjustable pressure level is exceeded.

In the apparatus, a switchable seat valve is interposed between a first parallel arrangement of the pilot valve and a third check valve and a second parallel arrangement of a fourth check valve and an adjustable choke position. In particular, the third check valve opens in the direction of the second work space when an adjustable pressure level in the first work space is exceeded, and opens in the direction of the first work space when subjected to corresponding pressure impact. Moreover, additional adjustable choke positions are interposed on the guiding-off side of the emergency valve, and arranged between the second work space and the second check valve, respectively.

Other features and advantages of the invention will become apparent upon reference to the following Description of the Exemplary Embodiment when read in light of the attached drawings.

BRIEF DESCRIPTION OF THE DRAWINGS

FIG. 1*a* is a schematic diagram of the apparatus of FIG. 1;

BRIEF DESCRIPTION OF THE EXEMPLARY EMBODIMENT

Figure 1:
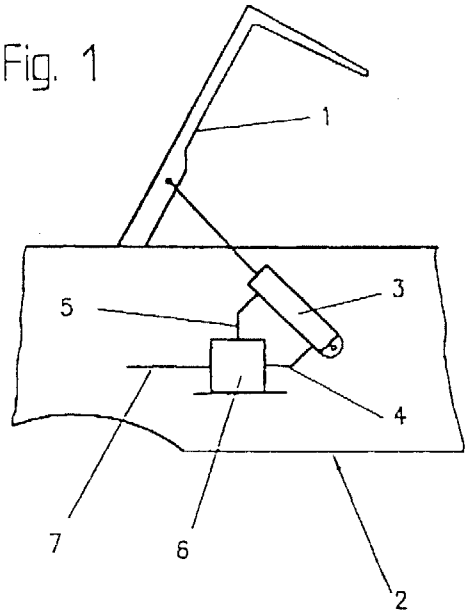
FIG. 1 is a cut-away schematic layout of an actuation apparatus according to the invention.

FIGS. 1 and 1*a* show the actuation apparatus according to an exemplary embodiment of the invention. In FIG. 1, the apparatus for hydraulic actuation of a hinged cover 1 on a vehicle 2 has at least one double-acting hydraulic working cylinder 3 hinged on both the vehicle 2 and the hinged cover 1. The cylinder 3 is connected, via lines 4 and 5, to a hydraulic aggregate 6, which in turn is connected, via a connecting line 7, to an electrical system (not shown) of the vehicle 2. In particular, the cylinder 3 has piston rod 3*a* connected to the hinged cover 1 for moving the hinged cover 1.

Instead of supporting the working cylinder 3 on both the vehicle 2 and the hinged cover 1, which naturally requires the lines 4 and 5 or the hydraulic aggregate 6 to move integrally with the working cylinder 3, the working cylinder 3 may be indirectly mounted on the vehicle 2 or the hinged cover 1 via, for instance, levers (not shown). Additionally, the working cylinder 3 can also be mounted in such a way that it is stationary relative to the vehicle 2.

As shown in FIG. 1*a*, first and second work spaces 8 and 9 of the working cylinder 3 are each connected to a reversible pressure source 12, preferably made of a pump and drive motor, via first and second check valves 10 and 11 within the hydraulic aggregate 6. In this instance, the first and second check valves 10 and 11, which are interconnected by lines 13 and 14, are reciprocally unclosable.

Through a pilot valve 15, the first and second work spaces 8 and 9 are connected in parallel to the first and second check valves 10 and 11. Interposed between the first work space 8 and the first check valve 10 is an emergency valve 17 for guiding an excess pressure medium to a tank 16 when an adjustable pressure level is exceeded. The emergency valve 17 can be hydraulically shut off via a line 18. Parallel to the pilot valve 15, a third check valve 19 is arranged which opens in the direction of the second work space 9 when the adjustable pressure level is exceeded, and which opens in the direction of the first work space 8 when impacted with pressure.

Furthermore, a parallel arrangement of a first choke position 20 with a fourth check valve 21, which opens in the direction of the first work space 8, is interposed between the pilot valve 15 and the first work space 8. A seat valve 22, electrically switchable when necessary, is interposed into the connection of the first and second work spaces 8 and 9 (i.e., between the two parallel arrangements of (1) the pilot valve 15 and the third check valve 1 and (2) the first choke position 20 and the fourth check valve 21). The first and second work spaces 8 and 9 can be completely separated by the seat valve 22. On one side (i.e., the guiding off side) of the emergency valve 17, a second adjustable choke position 23 is interposed. A third adjustable choke position 24 is arranged in the connection between the second work space 9 and the second check valve 11.

The connecting line 7 shown in FIG. 1 provides control for units such as the pressure source 12, the seat valve 22, and a shuttle valve 25, located between the two lines which lead to the tank 16 via first and second adjustable pressure control valves 26 and 27. In addition, limit switches or other position controls, for example, could send signals via this connecting line 7 to control units or the like not otherwise shown.

According to the exemplary embodiment of the invention, if the hydraulic working pressure fails, a simple, safe emergency actuation of the hinged cover 1 by hand is easily accomplished. For instance, when the working cylinder 3 is pulled out by hand, the work space volume of the second work space 9 is pushed over into the first work space 8, whereby the missing differential volume in the first work space 8 in the form of air blowing out can be condoned. Since this usually only accounts for a small percentage of the air volume, the resulting possibility of slight movement of the hinged cover 1 against this small air cushion is not inconvenient. Moreover, when the working cylinder 3 is pushed in by hand, the second work space 9 is completely filled from the work space volume in the first work space 8—the excess volume is guided off into the tank via the emergency valve 17 at the first such emergency actuation. In the case of subsequent further emergency actuations, there is simply a corresponding pushing over between the first and second work spaces 8 and 9, whereby the above described small differential quantity at any given time is missing or is condoned by the first work space 8. Accordingly, a very easy and safe emergency actuation of the working cylinder 3 is accomplished.

For the hinged cover 1 which opens when the working cylinder 3 is extending, the invention facilitates the emergency opening by hand through the use of the third check valve 19 which opens in the direction of the second work space as to allow, in practically unimpeded manner, the emergency actuation in the direction of the extending piston rod 3*a*, bypassing the pilot valve 15. Depending on the setting of the opening pressure of the pilot valve 15, the hinged cover 1 to be actuated can be braced in different positions against the force of gravity, whereby the set pressure threshold also directly affects the closing force required for the emergency actuation.

The parallel arrangement of the first choke position 20 and the fourth check valve 21 opening in the direction of the first work space 8 can (1) brake the insertion or pushing in of the working cylinder 3 or (2) allow unimpeded extending or pushing out during an emergency actuation. Additionally, the seat valve 22 permits separate controlling of the two work spaces. For instance, the seat valve is opened in emergency operation so that the emergency actuation is provided in unimpeded manner. Still further, the second adjustable choke position 23 influences the movement of the working cylinder 3 which is emergency-actuated for the first time in the direction of insertion. On the other hand, during the hydraulic closing as a result of pressure decrease, the third adjustable choke position 24 guarantees a safe opening of the hydraulically unclosable check valve on the piston side.

Figure 2:
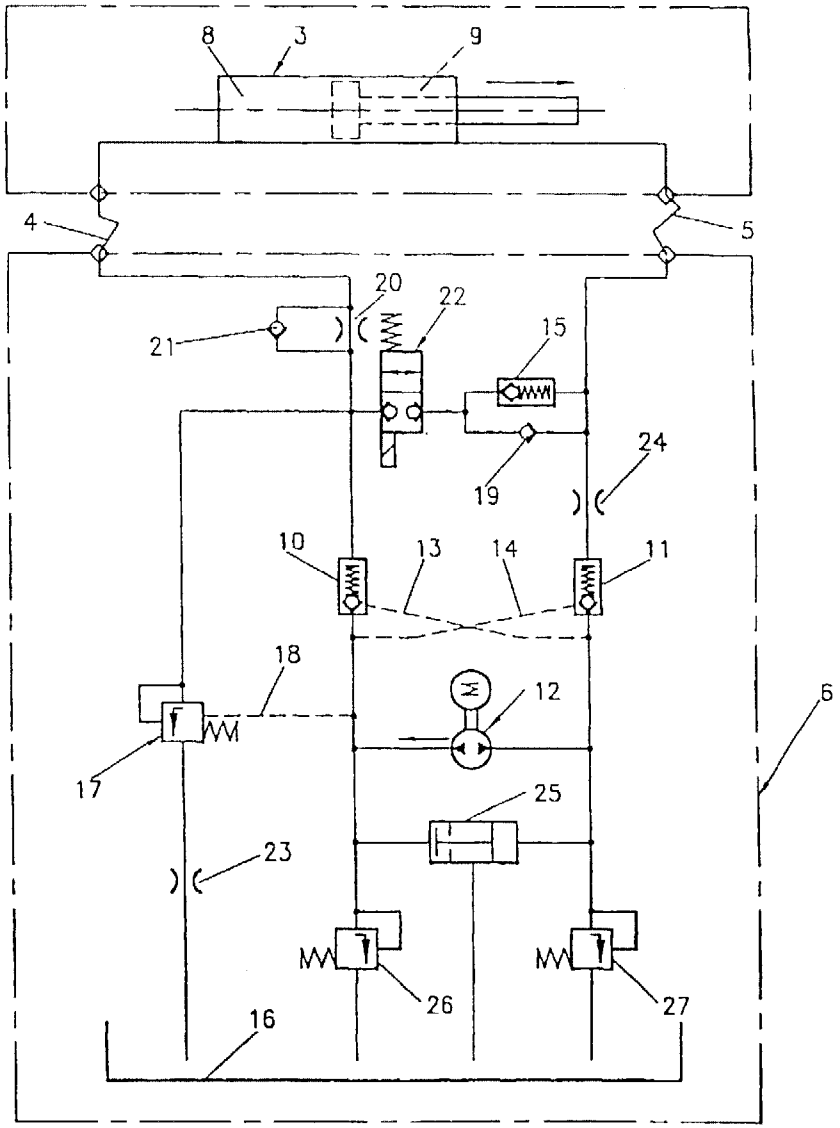
FIG. 2 is a schematic diagram showing an opening phase of the actuation apparatus of FIG. 1.

FIGS. 2–6 show various actuation phases of the actuation apparatus shown in FIGS. 1 and 1*a*. In FIG. 2, a hydraulic opening phase of the actuation apparatus is shown whereby the working cylinder 3 is extended. More specifically, the motor of the pump of the pressure source 12 is supplied with current, the pump runs and delivers a pressure medium via the first and fourth check valves 10 and 21 into the first work space 8. The seat valve 22 is also supplied with current, whereby, as illustrated, the connection to the second work space 9 is broken off. The emergency valve 17 is closed via the line 18. The pressure in the first work space 8 can build up to the required value. The hinged cover 1 hydraulically opens up to the stop in the working cylinder 3. The volume of the second work space 9 flows via the second check valve 11 hydraulically opened by the line 14 and via the shuttle valve 25 off into the tank 16. Depending on counterweight or counterforce on the hinged cover 1, the hydraulics deliver altogether the force adjustable at the first pressure control valve 26. The pump runs until the hinged cover 1 is opened and is then switched off. In addition, after the hydraulic opening the current for the seat valve 22 is also switched off, after which the hinged cover 1 is held in opened position by the pressure adjustable at the emergency valve 17.

Figure 3:
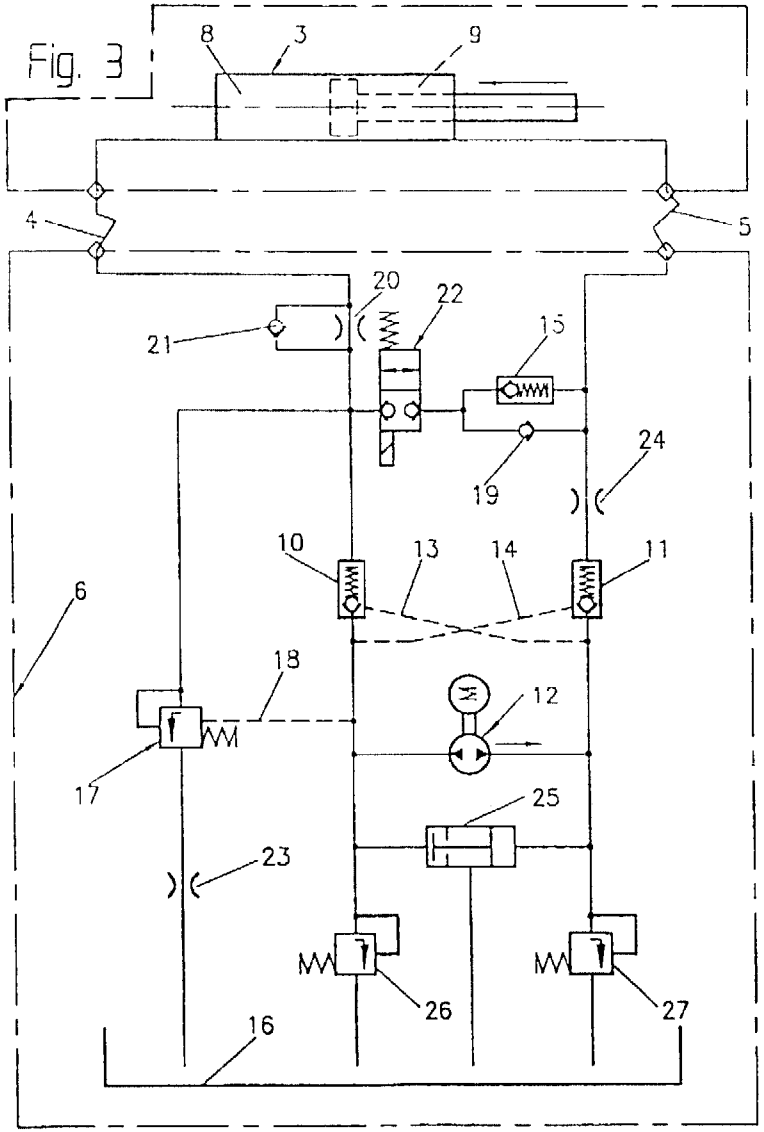
FIG. 3 is a schematic diagram showing a closing phase of the actuation apparatus of FIG. 1.

FIG. 3 illustrates a hydraulic closing phase of the actuation apparatus whereby the working cylinder 3 is driven according to first, second, or third phase. In the first phase, as shown in FIG. 3, the motor of the pump of the pressure source 12 is supplied with current. In this instance, the pressure medium is conveyed via the second check valve 11 and the third choke position 24 into the second work space 9. The seat valve 22 is in turn supplied with current and closed. The cover 1 closes with a force adjustable at the second pressure control valve 27. The seat valve 22 blocks the connection to the first work space 8. Due to the closed fourth check valve 21, the volume flowing out of the first work space 8 flows via the third choke position 24 and the first check valve 10 opened by the line 13 and via the shuttle valve 25 off into the tank 16. The third choke position 24 brings about a secure opening of the first check valve 10 as a result of the improved pressure buildup. In this way, the closing force is adjusted such that the hinged cover 1 closes securely even if the vehicle is in an inclined position or even under other unfavorable conditions. On the other hand, the closing force cannot be set higher than at the second pressure control valve 27, whereby it is easily achieved that the hinged cover 1 may also be stopped by hand if necessary.

In the second phase of the hydraulic closing, the motor of the pump of the pressure source 12 is still supplied with current, while the seat valve 22 has no current and is thus switched to through-feed. This is provided for safety reasons, because in this way, it becomes possible to stop the hinged cover 1 with substantially less expenditure of force. Since the pressure source 12 continues to deliver normally, a largely uniform downward movement is maintained and the second work space 9 is sufficiently filled. If the hinged cover 1 is halted by an obstruction, for example, the occurring pump volume flow proceeds into the tank 16 via the second and third check valves 11 and 19, the opened seat valve 22, the first check valve 10 opened by the line 13, and the shuttle valve 25.

In the third phase, again for safety reasons, the motor of the pressure source 12 and the seat valve 22 may remain without current, whereby the hinged cover 1 according to FIG. 1 drops into the completely closed position only by its own weight. In the event that it is stopped, only the weight of the hinged cover 1 is present, whereby any danger of injury is eliminated. The volume flow flowing off out of the first work space 8 flows partly via the first choke position 20, the opened seat valve 22, and the pilot valve 15 into the second work space 9 and partly through the prestressed emergency valve 17 and the second choke position 23 into the tank 16. Due to the filling of the second work space 9, noises in the hydraulics during a subsequent reopening of the hinged cover 1 are prevented. The first choke position 20 brakes, depending on the speed, the closing movement of the hinged cover 1, whereby the danger of injury is further reduced. In this phase the emergency valve 17 counteracts the relatively strong counterforce of the hinged cover 1, with the second choke position 23, the closing speed of the hinged cover 1 can be further fine-tuned.

Figure 4:
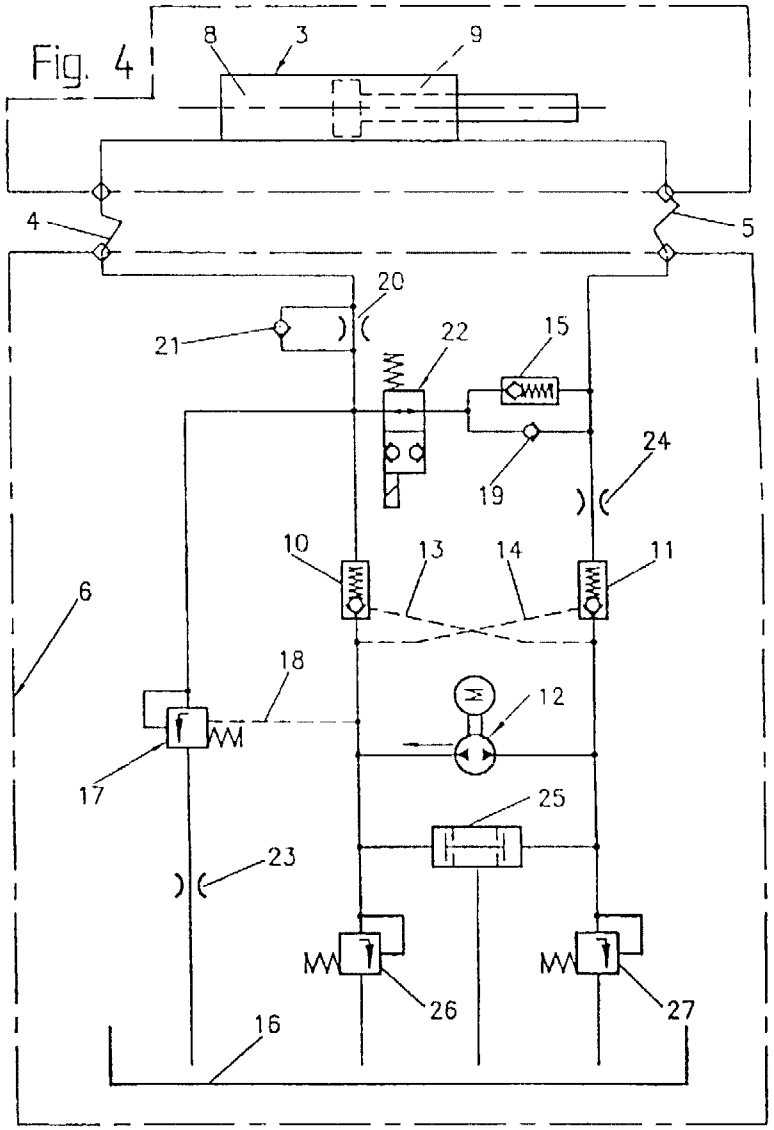
FIG. 4 is a schematic diagram showing a stop phase of the actuation apparatus of FIG. 1.

FIG. 4 illustrates the stop phase of the actuation apparatus. More specifically, the motor of the pump of the pressure source 12 is without current, and the seat valve 22 is supplied with current briefly until the hinged cover 1 has braked or come to a halt. Thereafter, the current for the seat valve 22 is switched off, which is quite advantageous with regard to the energy consumption of a vehicle battery, for example. This stop function may occur at any time within the range of the above-described two first phases of the closing. The hinged cover 1 is held by the pressure adjusted at the emergency valve 17. In the arrangement of the hinged cover 1 shown in FIG. 1, no separate stop function is provided for in the above described third phase of the complete closing produced solely by the weight of the hinged cover 1. But this is not a disadvantage because, as described, the hinged cover 1 can also easily be halted by hand.

Figure 5:
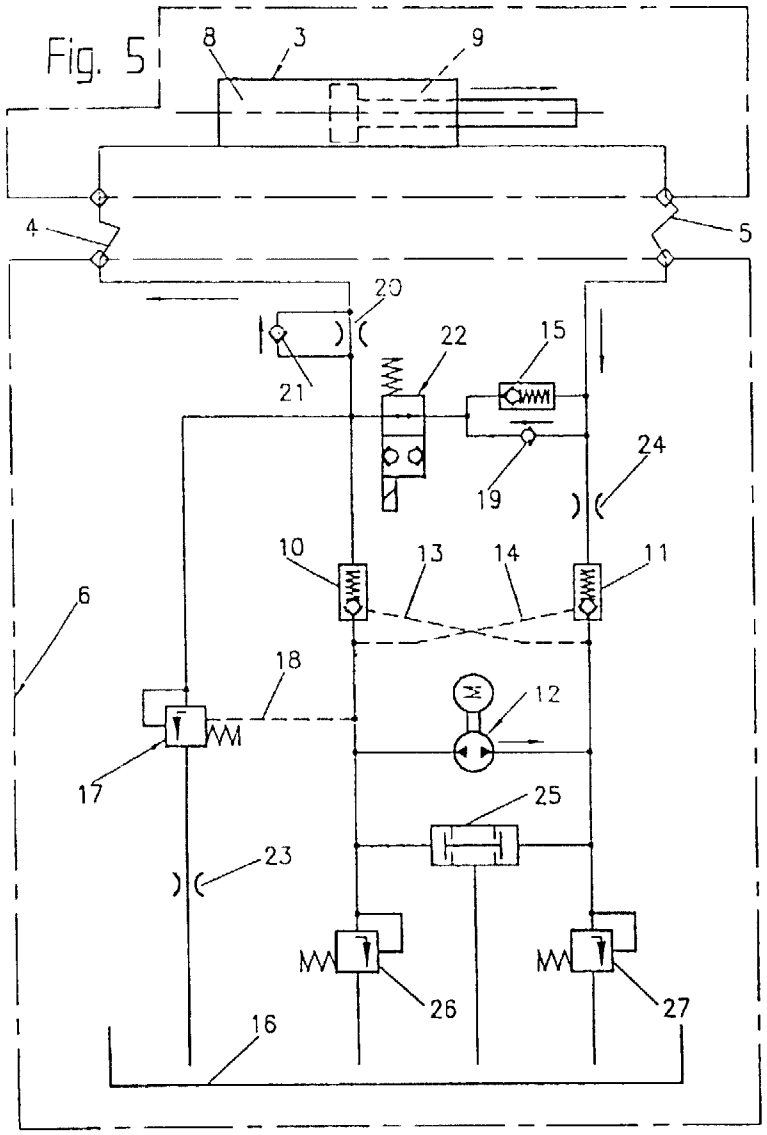
FIG. 5 is a schematic diagram showing an emergency opening phase of actuation apparatus of FIG. 1.

FIG. 5 shows an opening phase of the apparatus during an emergency actuation whereby the opening of the hinged cover 1 is accomplished by hand even though the pressure source 12 has failed due to the lack of current supply. More specifically, the hinged cover 1 can be opened with relatively little expenditure of force. Only the weight of the hinged cover 1 itself, as well as the flow resistance in the hydraulics, need to be overcome. Gas springs eventually built into the vehicle and acting on the hinged cover 1 also have a supporting effect. As can be seen, the pressure medium flows nearly without pressure from the second work space 9 and thus with little required expenditure of force via the third check valve 19, the seat valve 22 and the fourth check valve 21 into the first work space 8 and fills it up. This is extremely important to ensure that the hinged cover 1 remains still after such an emergency actuation and cannot fall back against an air cushion in this work space 8, which could present a great safety hazard. As a result of the underpressure when the first work space 8 is not filled, air would be released from the pressure medium. The differential volume thus naturally lacking, during filling of the work space on the piston side, as a result of the small volume of the second work space 9 is only a few percent and insignificant from the point of view of safety.

Figure 6:
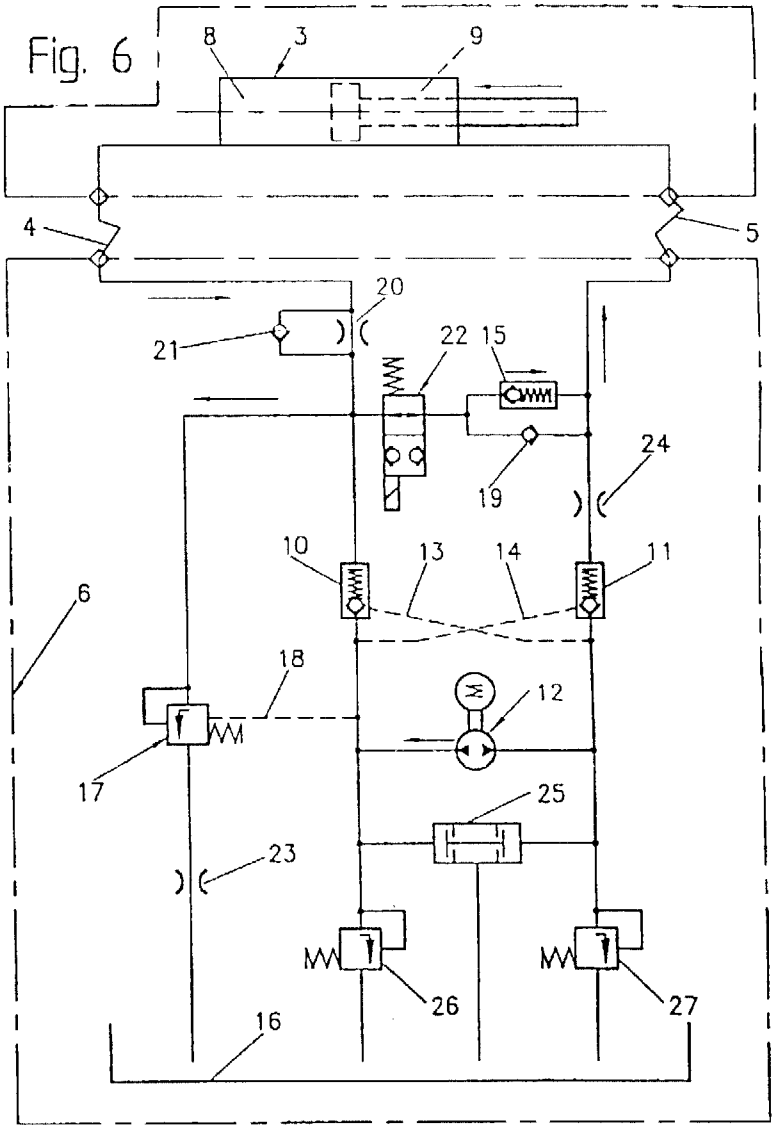
FIG. 6 is a schematic diagram showing an emergency closing phase the apparatus of FIG. 1.

FIG. 6 shows a closing phase of the apparatus during an emergency actuation whereby the closing of the hinged cover 1 is accomplished by hand if the pump drive fails, for example. In this connection, the volume flow flows from the first work space 8 via the first choke position 20, the seat valve 22 and the pilot valve 15 into the second work space 9 and fills it up. The first choke position 20 has the function of braking harder when the closing speed is too fast than when the closing speed is slow. The pilot valve 15 acts against the weight of the hinged cover 1 in a supporting manner. The first time such an emergency actuation takes place, the excess differential volume of the working cylinder 3 can flow off via the emergency valve 17, whereby it should be noted that the pressure set at this emergency valve 17 is greater than that at the pilot valve 15.

Aside from the illustrated and described arrangement of a hinged cover 1 according to FIG. 1 (for example, on a car trunk or engine hood), the apparatus according to the exemplary embodiment of the invention can also be used for the actuation of vertical tailgates of a station wagon or a bus, for example. Other examples of application would be vehicle doors, maintenance or ventilation flaps, etc.

While particular exemplary embodiments of the present invention have been shown and described, it will be apparent to those skilled in the art that various changes and modifications may be made therein without departing from the spirit or scope of the invention. Accordingly, it is intended that the appended claims cover such changes and modifications that come within the spirit and scope of the invention.

What is claimed is:

1. An apparatus for hydraulic actuation of a hinged cover on a vehicle, comprising:

a double-acting hydraulic working cylinder having first and second work spaces, said cylinder supported by said vehicle and said cover;

a reversible pressure source;

first and second check valves which are reciprocally unclosable;

a pilot valve; and an emergency valve interposed between the first work space and the first check valve, said first and second work spaces connected to said reversible pressure source via said first and second check valves, and connected in parallel to said first and second check valves via said pilot valve, wherein said emergency valve, which can be hydraulically shut-off, guides an excess pressure medium to a tank when an adjustable pressure level is exceeded.

2. The apparatus according to claim 1, further comprising a third check valve arranged in parallel to the pilot valve, said third check valve opening in the direction of the second work space when an adjustable pressure level in the first work space is exceeded, and opening in the direction of the first work space when subjected to corresponding pressure impact.

3. The apparatus according to claim 1, wherein a parallel arrangement of an adjustable choke position and a fourth check valve opening in the direction of the first work space is interposed between the pilot valve and the first work space.

4. The apparatus according to claim 2, wherein a parallel arrangement of an adjustable choke position and a fourth check valve opening in the direction of the first work space is interposed between the pilot valve and the first work space.

5. The apparatus according to claim 1, wherein a switchable seat valve is interposed between a first parallel arrangement of the pilot valve and a third check valve and a second parallel arrangement of a fourth check valve and an adjustable choke position.

6. The apparatus according to claim 2, wherein a switchable seat valve is interposed between the parallel arrangement of the pilot valve and the third check valve and another parallel arrangement of a fourth check valve and an adjustable choke position.

7. The apparatus according to claim 3, wherein a switchable seat valve is interposed between a parallel arrangement of the pilot valve and a third check valve and the parallel arrangement of the fourth check valve and the adjustable choke position.

8. The apparatus according to claim 1, wherein an adjustable choke position is interposed on the guiding-off side of the emergency valve.

9. The apparatus according to claim 2, wherein an adjustable choke position is interposed on the guiding-off side of the emergency valve.

10. The apparatus according to claim 3, wherein another adjustable choke position is interposed on the guiding-off side of the emergency valve.

11. The apparatus according to claim 4, wherein another adjustable choke position is interposed on the guiding-off side of the emergency valve.

12. The apparatus according to claim 1, wherein an adjustable choke position is arranged between the second work space and the second check valve.

13. The apparatus according to claim 2, wherein an adjustable choke position is arranged between the second work space and the second check valve.

14. The apparatus according to claim 3, wherein another adjustable choke position is arranged between the second work space and the second check valve.

15. The apparatus according to claim 4, wherein another adjustable choke position is arranged between the second work space and the second check valve.

16. The apparatus according to claim 5, wherein another adjustable choke position is arranged between the second work space and the second check valve.

* * * * *